US012196054B2

(12) United States Patent
Urban et al.

(10) Patent No.: US 12,196,054 B2
(45) Date of Patent: Jan. 14, 2025

(54) SEAL BACKUP AND SEAL SYSTEM

(71) Applicant: Baker Hughes Oilfield Operations LLC, Houston, TX (US)

(72) Inventors: Larry Urban, Santa Fe, TX (US); Marcus Avant, Kingwood, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 36 days.

(21) Appl. No.: 18/071,962

(22) Filed: Nov. 30, 2022

(65) Prior Publication Data

US 2024/0175333 A1 May 30, 2024

(51) Int. Cl.
*E21B 33/12* (2006.01)

(52) U.S. Cl.
CPC ..... *E21B 33/1216* (2013.01)

(58) Field of Classification Search
CPC ..... E21B 33/1216
See application file for complete search history.

(56) References Cited

U.S. PATENT DOCUMENTS

| | | | |
|---|---|---|---|
| 49,783 | A | 9/1865 | Parham, Jr. |
| 3,346,267 | A | 10/1967 | Farley |
| 4,162,079 | A | 7/1979 | Jelinek |
| 6,896,049 | B2 | 5/2005 | Moyes |
| 8,151,894 | B2 | 4/2012 | Nutley et al. |
| 9,228,411 | B2 | 1/2016 | Themig |
| 9,359,860 | B2 | 6/2016 | Hallundbaek et al. |
| 9,732,581 | B2 | 8/2017 | Morehead |
| 9,784,066 | B1 | 10/2017 | Branton et al. |
| 10,443,343 | B2 | 10/2019 | Doane et al. |
| 2005/0023003 | A1 | 2/2005 | Echols et al. |
| 2006/0219415 | A1 | 10/2006 | Xu |
| 2008/0296845 | A1 | 12/2008 | Doane et al. |
| 2009/0277648 | A1 | 11/2009 | Nutley et al. |

(Continued)

FOREIGN PATENT DOCUMENTS

| | | | |
|---|---|---|---|
| EP | 1408195 | B1 | 4/2004 |
| WO | 2019051468 | A1 | 3/2019 |

OTHER PUBLICATIONS

Notification of the International Search Report and Written Opinion; PCT/US2023/080889; Korean Intellectual Property Office; Mailed Feb. 28, 2024; 10 pages.

(Continued)

*Primary Examiner* — D. Andrews
(74) *Attorney, Agent, or Firm* — CANTOR COLBURN LLP

(57) ABSTRACT

A backup includes an anchor portion, an operable portion extending from the tip of the anchor portion, and an S section having a curvilinear line therein and where a substantially constant thickness of material from the line to an inside surface of the S section and a substantially nonconstant thickness of material from the curvilinear line toward an outside surface. A backup system including a backup, a gauge ring engageable with the anchor portion, the gauge ring including a contact surface with a back angle configured to engage the S section when the backup is set. A seal system including a mandrel, a backup, disposed on the mandrel, a gauge ring disposed on the mandrel and configured to interact with the backup; and a seal element disposed on the mandrel.

9 Claims, 3 Drawing Sheets

(56) References Cited

U.S. PATENT DOCUMENTS

| | | | | |
|---|---|---|---|---|
| 2010/0186970 | A1 | 7/2010 | Burnett et al. | |
| 2010/0263857 | A1 | 10/2010 | Frazier | |
| 2010/0276137 | A1* | 11/2010 | Nutley | E21B 33/1208 166/185 |
| 2011/0037229 | A1* | 2/2011 | Clarke | E21B 33/1216 277/322 |
| 2012/0055667 | A1 | 3/2012 | Ingram et al. | |
| 2012/0133098 | A1 | 5/2012 | Farquhar | |
| 2012/0217025 | A1 | 8/2012 | Shkurti et al. | |
| 2013/0147121 | A1 | 6/2013 | Xu | |
| 2014/0290946 | A1* | 10/2014 | Nguyen | E21B 33/1204 166/179 |
| 2014/0319783 | A1 | 10/2014 | Gomez et al. | |
| 2016/0097252 | A1 | 4/2016 | Resink | |
| 2018/0087346 | A1* | 3/2018 | Rochen | E21B 33/128 |
| 2018/0172160 | A1 | 6/2018 | Urban et al. | |
| 2018/0320473 | A1* | 11/2018 | Xu | E21B 33/128 |
| 2019/0040710 | A1 | 2/2019 | Deng et al. | |
| 2019/0249511 | A1 | 8/2019 | Deng et al. | |
| 2019/0330956 | A1 | 10/2019 | Urban | |
| 2019/0368304 | A1 | 12/2019 | Deng et al. | |
| 2022/0081991 | A1 | 3/2022 | Deng et al. | |
| 2022/0195829 | A1 | 6/2022 | Urban et al. | |
| 2022/0195849 | A1* | 6/2022 | Urban | E21B 43/106 |

OTHER PUBLICATIONS

Notification of Transmittal of the International Search Report and the Written Opinion of the International Searching Authority, or the Declaration; PCT/US2021/073011; Mail date: Apr. 15, 2022: 10 pages.

Notification of Transmittal of the International Search Report and the Written Opinion of the International Searching Authority, or the Declaration; PCT/US2021-073010; Mail date: Apr. 1, 2022: 10 pages.

Yablon, Dalia, Confusion of moduli, Nov. 16, 2017, Wiley Analytical Science, Available from: https://analyticalscience.wiley.com/do/10.1002/micro.2417/full/ (Year: 2017).

* cited by examiner

SEAL BACKUP AND SEAL SYSTEM

BACKGROUND

In the resource recovery and fluid sequestration industries, seals are commonplace. Ensuring reliability of such seals is important. Backups are used with seals to prevent or at least deter seal extrusion under pressure. While backups of the prior art have helped in this regard, downhole operations continue to use higher pressures and prior art backups are not always up to the task. The art therefore will well receive new backups that provide for higher pressure ratings.

SUMMARY

An embodiment of a backup including an anchor portion, having a thickness of material from a centerline of the anchor portion toward an outside surface of the anchor portion that is equal to a thickness of material from the centerline of the anchor portion to an inside surface of the anchor portion, the centerline having a first end point at a base of the anchor portion and a second end point at a tip of the anchor portion, an operable portion extending from the tip of the anchor portion, the operable portion including a wedge section, the wedge section having a thickness of material from a centerline of the wedge section toward an outside surface of the wedge section that is equal to a thickness of material from the centerline of the wedge section to an inside surface of the wedge section, the centerline having a first end point at a tip of the wedge section and a second end point at a base of the wedge section, and an S section defined by a thickness of material that is substantially constant from a curvilinear line beginning at the second end point of the tip of the anchor portion and extending to the first end point of the base of the wedge section toward an inside surface of the S section and a thickness of material from the curvilinear line toward an outside surface of the S section that is substantially nonconstant and thicker than the substantially constant thickness.

An embodiment of a backup system including a backup, a gauge ring engageable with the anchor portion, the gauge ring including a contact surface configured to engage the S section when the backup is set, the contact surface having back angle.

An embodiment of a seal system including a mandrel, a backup, disposed on the mandrel, a gauge ring disposed on the mandrel and configured to interact with the backup; and a seal element disposed on the mandrel.

An embodiment of a borehole system including a borehole in a subsurface formation, a string in the borehole, and a backup disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
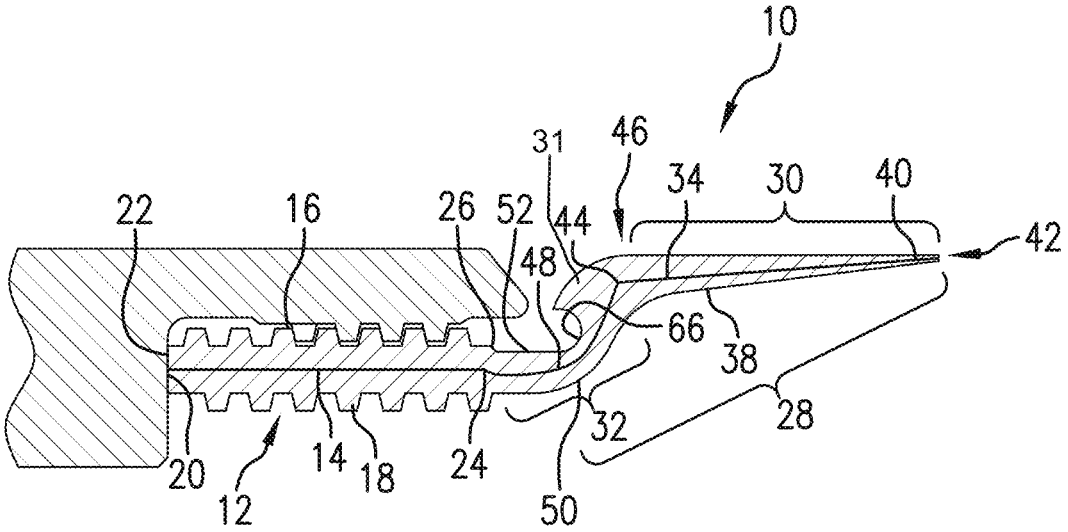
FIG. 1 is a sectional view of a backup as disclosed herein in a run in condition.

Referring to FIG. 1, a backup 10 is illustrated. The backup 10 comprises an anchor portion 12, having a thickness of material from a centerline 14 of the anchor portion 12 toward an outside surface 16 of the anchor portion 12 that is equal to a thickness of material from the centerline 14 of the anchor portion 12 to an inside surface 18 of the anchor portion 12, the centerline 14 having a first end point 20 at a base 22 of the anchor portion 12 and a second end point 24 at a tip 26 of the anchor portion 12.

Backup 10 further comprises an operable portion 28 extending from the tip 26 of the anchor portion 12. The operable portion 28 is broken into two sections for clarity of discussion and elucidation of particular structure of the backup. One section is a wedge section 30, with a wedge tail 31, and the other section is an S section 32, the wedge tail 31 extending in a direction opposite a direction of extension of the wedge section 30 relative to a point of intersection of the S section 32 and the wedge section 30. The wedge section 30 has a thickness of material from a centerline 34 thereof to an outside surface 36 that is equal to a thickness of material from the centerline 34 to an inside surface 38 of the wedge section 30. The centerline 34 has a first end point 40 at a tip 42 of the wedge section 30 and a second end point 44 at a base 46 of the wedge section 30. The end points 24 and 44 are then used to form the ends of a curvilinear line 48 that runs through the S section 32.

The line 48 tracks a curve of an inside surface 50 of the S section 32 and maintains substantially the same spacing therefrom such that a thickness of material of the S section 32 is substantially constant between the inside surface 50 and the curvilinear line 48. Conversely, a thickness of material from the curvilinear line 48 toward an outside surface 52 of the S section 32 is substantially nonconstant and thicker than the substantially constant thickness. This is important to the function of the backup 10. The thickness of the S section between the line 48 and outside surface 52 is very different than standard prior art backup rings. For known backup rings, the thickness of material at either side of a line similar to the lines defined in this specification would be the same or would be thicker toward the inside surface rather than toward the outside surface as is the case with the disclosed backup 10. Because of the positioning of what might be termed "extra material" i.e. toward the outside surface 52, two functional attributes are achieved. First, greater strength is obtained in an area of the backup that will contact a gauge ring (discussed further later) and second, the added thickness allows for a deeper concavity (again discussed further hereunder) to form a hinge. These attributes cause lower resistance to setting initially and higher resistance to deformity after setting. The result is a backup that is easy to set and yet will attain higher load ratings in testing.

Thickness of the S section 32 at interface surface 64 gives a substantial amount of strength and also the deep concavity 66 that may be radiused in some embodiments, make for an excellent hinge that improves deformation during setting.

Figure 2:
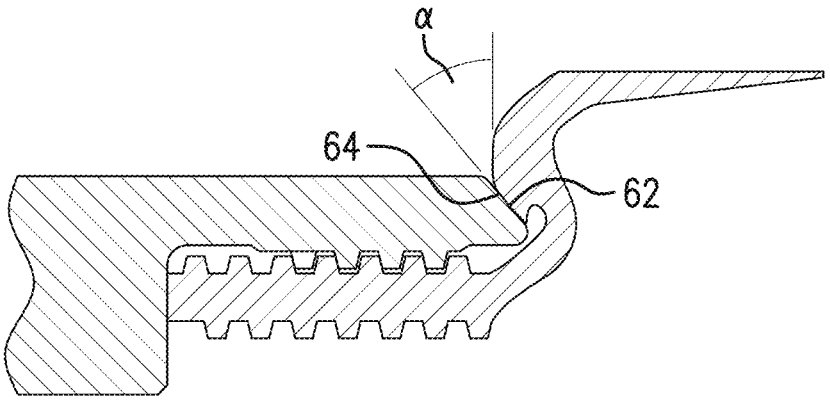
FIG. 2 is a sectional view of the backup of FIG. 1 in a set condition.

In a system, the backup 10 is paired with a gauge ring 60. The gauge ring 60 is similar to prior art gauge rings but includes a contact surface 62 that has a back angle a (see FIG. 2) that is less than 90 degrees from perpendicular to a longitudinal extent of the gauge ring 60 and greater than 0 degrees to the longitudinal extent of the gauge ring 60. The back angle serves two functions. First is to support the backup 10 when it contacts interface 64 of S section 32 during setting and second to create a force on the gauge ring 60 that tends to prevent the ring 60 from opening up at the threads on the anchor portion.

Figure 3:
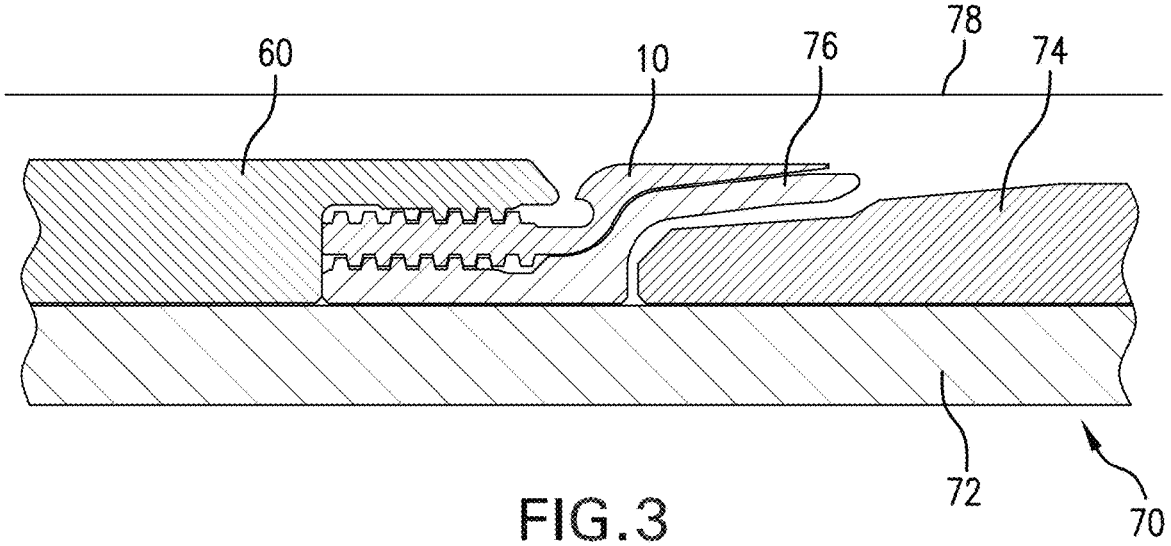
FIG. 3 is a sectional view of a seal system using the backup of FIG. 1 in a run in condition.
Figure 4:
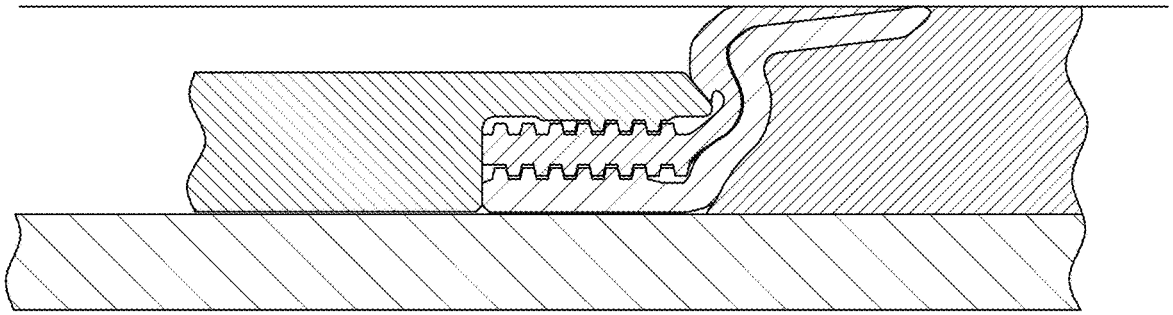
FIG. 4 is a sectional view of the seal system of FIG. 3 in a set condition.

Referring to FIGS. 3 and 4, a seal system 70 includes a mandrel 72, an element 74, a backup 10, a gauge ring 60 and optionally a spacer ring 76. The unset condition is illustrated in FIG. 3 while the set condition is illustrated in FIG. 4. It will be appreciated by one or skill in the art to which the disclosure pertains that energy is imparted to the element 74 in a number of ways such as set down weight for example. The element will be squeezed between structures on its ends (only one end shown but a mirror image may be on the other end of the element). During squeezing, the element will move radially outwardly from the mandrel 72 and into contact with a tubular wall 78, while at the same time deforming backup 10 into the shape illustrated in FIG. 4. It will be appreciated from this view of FIG. 4 that the backup 10 is in a position to both contain the element 74 to prevent extrusion and at the same time using the energy in the backup 10 to force the gauge ring contact surface 62 toward the mandrel 72, thereby reducing the possibility that the gauge ring 60 might deform away from the mandrel 72 and lose securement of the backup 10.

Figure 5:
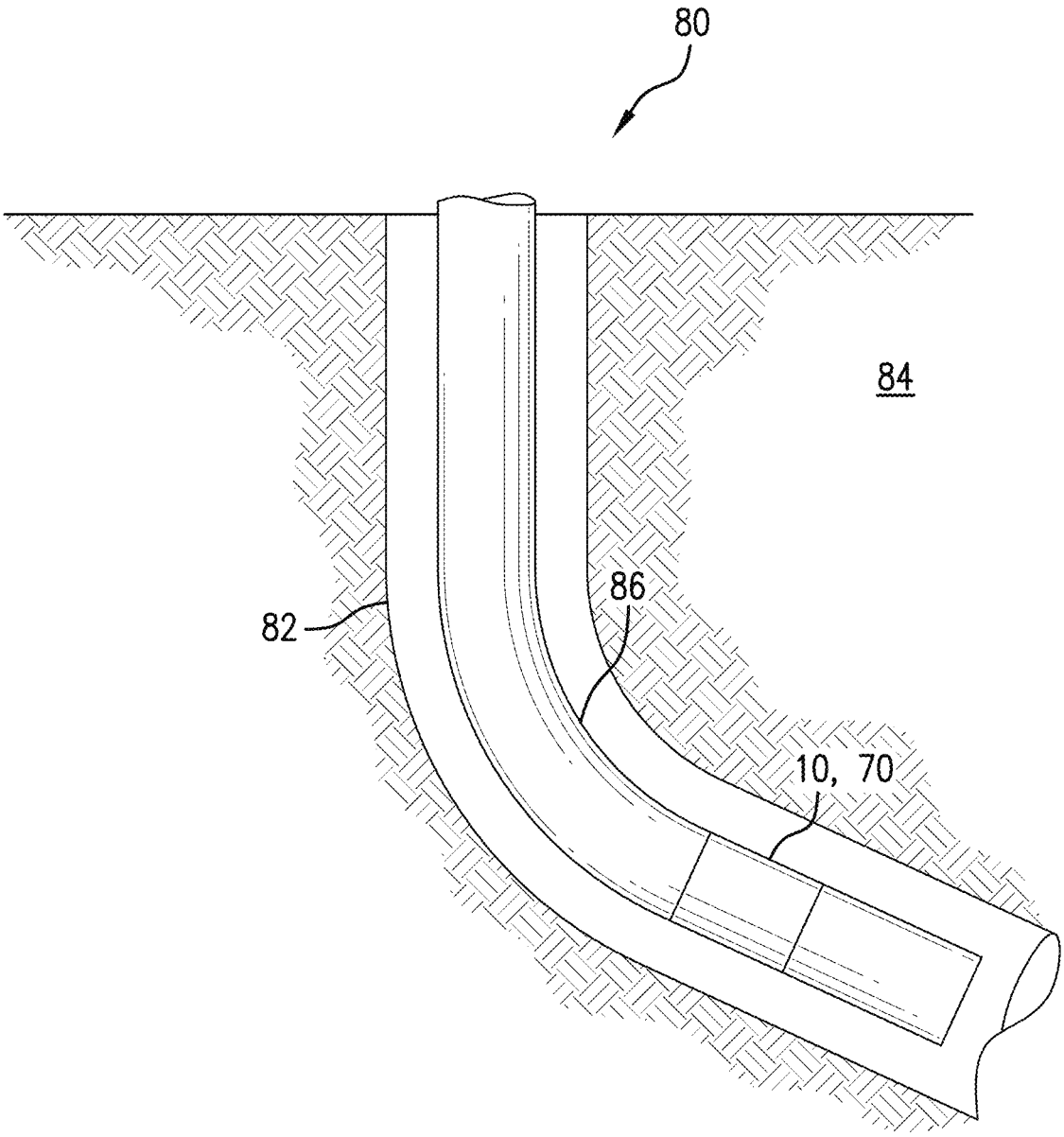
FIG. 5 is a view of a borehole system including the backup or seal system as disclosed herein.

Referring to FIG. 5, a borehole system 80 is illustrated. The system 80 comprises a borehole 82 in a subsurface formation 84. A string 86 is disposed within the borehole 82. A backup 10 as disclosed herein or a system 70 as disclosed herein is disposed within or as a part of the string 86.

Set forth below are some embodiments of the foregoing disclosure:

Embodiment 1: A backup including an anchor portion, having a thickness of material from a centerline of the anchor portion toward an outside surface of the anchor portion that is equal to a thickness of material from the centerline of the anchor portion to an inside surface of the anchor portion, the centerline having a first end point at a base of the anchor portion and a second end point at a tip of the anchor portion, an operable portion extending from the tip of the anchor portion, the operable portion including a wedge section, the wedge section having a thickness of material from a centerline of the wedge section toward an outside surface of the wedge section that is equal to a thickness of material from the centerline of the wedge section to an inside surface of the wedge section, the centerline having a first end point at a tip of the wedge section and a second end point at a base of the wedge section, and an S section defined by a thickness of material that is substantially constant from a curvilinear line beginning at the second end point of the tip of the anchor portion and extending to the first end point of the base of the wedge section toward an inside surface of the S section and a thickness of material from the curvilinear line toward an outside surface of the S section that is substantially nonconstant and thicker than the substantially constant thickness.

Embodiment 2: The backup as in any prior embodiment, wherein the outside surface of the S section includes a concavity therein.

Embodiment 3: The backup as in any prior embodiment, wherein the concavity is radiused.

Embodiment 4: The backup as in any prior embodiment, wherein the concavity forms a hinge of the backup.

Embodiment 5: The backup as in any prior embodiment, wherein the outside surface of the S section includes a support surface having an angle that complements an angle of a gauge ring when the backup is set.

Embodiment 6: A backup system including a backup as in any prior embodiment, a gauge ring engageable with the anchor portion, the gauge ring including a contact surface configured to engage the S section when the backup is set, the contact surface having back angle.

Embodiment 7: The system as in any prior embodiment, wherein the back angle is less than 90 degrees to a longitudinal extent of the gauge ring.

Embodiment 8: The system as in any prior embodiment, wherein the backup angle is more than 0 degrees from the longitudinal extent of the gauge ring.

Embodiment 9: A seal system including a mandrel, a backup, as in any prior embodiment, disposed on the mandrel, a gauge ring disposed on the mandrel and configured to interact with the backup; and a seal element disposed on the mandrel.

Embodiment 10: The system as in any prior embodiment further including a spacer ring between the seal element and the backup.

Embodiment 11: A borehole system including a borehole in a subsurface formation, a string in the borehole, and a backup as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A backup comprising:

an anchor portion, having a thickness of material from a centerline of the anchor portion toward an outside surface of the anchor portion and a thickness of material from the centerline of the anchor portion to an inside surface of the anchor portion, the centerline having a first end point at a base of the anchor portion and a second end point at a tip of the anchor portion;

an operable portion extending from the tip of the anchor portion, the operable portion comprising:

a wedge section, the wedge section having a thickness of material from a centerline of the wedge section toward an outside surface of the wedge section that is equal to a thickness of material from the centerline of the wedge section to an inside surface of the wedge section, the centerline having a first end point at a tip of the wedge section and a second end point at a base of the wedge section;

an S section defined by a thickness of material that is substantially constant from a curvilinear line beginning at the second end point of the tip of the anchor portion and extending to the first end point of the base of the wedge section toward an inside surface of the S section and a thickness of material from the curvilinear line toward an outside surface of the S section that is substantially nonconstant and thicker than the substantially constant thickness, the S section material from the curvilinear line toward the outside surface of the S section being thinner adjacent the anchor portion than the S section material from the curvilinear line toward the outside surface of the S section is adjacent the wedge section; and a wedge tail extending in a direction opposite a direction of extension of the wedge section with respect to a point of intersection of the S section and the wedge section.

2. The backup as claimed in claim 1, wherein the outside surface of the S section includes a concavity therein.

3. The backup as claimed in claim 2, wherein the concavity is radiused.

4. The backup as claimed in claim 2, wherein the concavity forms a hinge of the backup.

5. The backup as claimed in claim 1, wherein the outside surface of the S section includes a support surface having an angle that complements an angle of a gauge ring when the backup is set.

6. A backup system comprising;

a backup as claimed in claim 1;

a gauge ring engageable with the anchor portion, the gauge ring including a contact surface configured to engage the S section when the backup is set, the contact surface having a back angle, being less than 90 degrees to a longitudinal extent of the gauge ring and more than 0 degrees from the longitudinal extent of the gauge ring.

7. A seal system comprising:

a mandrel;

a backup, as claimed in claim 1, disposed on the mandrel;

a gauge ring disposed on the mandrel and configured to interact with the backup;

and a seal element disposed on the mandrel.

8. The system as claimed in claim 7 further including a spacer ring between the seal element and the backup.

9. A borehole system comprising:

a borehole in a subsurface formation;

a string in the borehole; and a backup as claimed in claim 1 disposed within or as a part of the string.

* * * * *